US010030347B2

(12) United States Patent
Kemp

(10) Patent No.: US 10,030,347 B2
(45) Date of Patent: Jul. 24, 2018

(54) GUY WIRE ANCHORING SYSTEMS, BRACKETS AND KITS

(71) Applicant: Hubbell Incorporated, Shelton, CT (US)

(72) Inventor: Timothy Michael Kemp, Columbia, MO (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/967,445

(22) Filed: Dec. 14, 2015

(65) Prior Publication Data

US 2016/0168815 A1 Jun. 16, 2016

Related U.S. Application Data

(60) Provisional application No. 62/091,918, filed on Dec. 15, 2014.

(51) Int. Cl.

| | |
|---|---|
| ***E02D 5/74*** | (2006.01) |
| ***E02D 5/80*** | (2006.01) |
| ***E04H 12/20*** | (2006.01) |

(52) U.S. Cl.

CPC ..... *E02D 5/801* (2013.01); *E04H 12/20* (2013.01)

(58) Field of Classification Search

CPC ..... E02D 5/801; E02D 5/80; E04H 12/20; E04H 12/085; E04H 12/2223; H01Q 1/12; F05B 2240/912; Y10T 403/341

See application file for complete search history.

(56) References Cited

U.S. PATENT DOCUMENTS 2,063,052 A * 12/1936 Robins ..... E02D 5/801 52/157
2,410,245 A * 10/1946 Scrivener ..... E04H 12/20 403/293
4,825,604 A * 5/1989 Manning ..... E02D 5/80 52/155
5,135,192 A * 8/1992 Winkler ..... E04H 12/2223 248/156
5,515,656 A * 5/1996 Mihalich ..... E02D 5/80 248/156
5,797,266 A 8/1998 Mackarvich (Continued)

OTHER PUBLICATIONS

International Search Report and Written Opinion dated in PCT/US2015/065694 on Feb. 18, 2016.

*Primary Examiner* — Brian D Mattei
(74) *Attorney, Agent, or Firm* — Wissing Miller LLP

(57) ABSTRACT

The present disclosure provides guy wire anchoring brackets, guy wire anchoring kits, and guy wire anchoring systems that effectively reduce the land right-of-way needed to anchor guy wires attached to free standing structures. The guy wire anchoring brackets interconnect one or more helical piles in an angular relationship so that they act in unison to resist loading and reduce the real estate needed to anchor guy wires. The guy wire anchoring kits includes a pile connector assembly and the guy wire anchoring bracket capable of interconnecting one or more helical piles in an angular relationship so that they act in unison to resist loading. The guy wire anchoring systems include the guy wire anchoring bracket, one or more helical piles and one or more pile connector assemblies that connect the one or more helical piles to the guy wire anchoring bracket.

17 Claims, 15 Drawing Sheets

(56) References Cited

U.S. PATENT DOCUMENTS

| | | | | |
|---|---|---|---|---|
| 6,132,141 | A * | 10/2000 | Kirk | E02D 5/801 248/49 |
| 6,272,798 | B1 * | 8/2001 | Cockman | E02D 5/801 135/118 |
| 6,298,611 | B1 | 10/2001 | Oliver et al. | |
| 6,871,455 | B1 * | 3/2005 | Cockman | E02D 5/801 135/118 |
| 7,059,095 | B1 | 6/2006 | Stevens et al. | |
| 2004/0261330 | A1 * | 12/2004 | Oliver | E02D 5/801 52/155 |
| 2008/0302028 | A1 | 12/2008 | Lewenhoff | |

* cited by examiner

DETAIL C

SECTION B-B

GUY WIRE ANCHORING SYSTEMS, BRACKETS AND KITS

CROSS-REFERENCE TO RELATED APPLICATIONS

The present disclosure is based on and claims benefit from co-pending U.S. Provisional Application Ser. No. 62/091,918 filed Dec. 15, 2014 entitled "Guy Wire Anchoring Bracket and Kit", the entire contents of which are herein incorporated by reference.

BACKGROUND

Field

The present disclosure relates generally to guy wire anchoring systems, kits and brackets. More particularly, the present disclosure relates to guy wire anchoring systems, kits and brackets that effectively reduce the land right-of-way needed to anchor guy wires and stabilize free standing structures.

Description of the Related Art

A guy wire or guy is a tensioned cable, rope or strand that adds stability to free-standing structures. A vertical free standing structure supported by guy wires is sometimes called a guyed mast. Referring to FIG. 1, guy wires 10 are typically used to add stability to radio transmission towers, utility poles and other free standing structures 12. One end 10*a* of the guy wire 10 is attached to the free standing structure 12, which is either partially buried in the ground or otherwise anchored to the ground, and the other end 10*b* of the guy wire is anchored to the ground at a distance "D" from the free standing structure's base.

When anchoring free standing structures 12 to the ground, such as radio transmission towers and utility poles, the angle between the vertical axis of the free standing structure and the diagonal of the guy wire is typically set at 45 degrees, and the angle between the ground and the diagonal of the guy wire is also typically at 45 degrees. This configuration maintains a right triangle between the free standing structure 12 and the ground, which provides the desired stabilizing support for the free standing structure. The tension in the diagonal of guy-wire 10, combined with the compressional strength of the free standing structure 12, allows the free standing structure 12 to withstand lateral loads, such as wind or the weight of cantilevered structures attached to the free standing structure. As shown in FIG. 2, guy wires are often positioned radially about the free standing structure at equal angles, for example in trios and quads, which allows the tension of each guy wire to offset the others and stabilize the free standing structure. For example, radio transmission towers or antenna masts are often stabilized by three guy-wires positioned at 120 degree angles relative to each other.

For ground based free standing structures, the guys are typically ground-anchored guys, where the guy is attached to a ground based structure which is called an anchor. As is known in the art, the height of the free standing structure 12, the height at which the guy wire 10 is secured to the free standing structure and the standardized 45 degree angle are factors that determine the distance "D" the guy wire anchor 14 needs to be positioned in the ground relative to the free standing structure 12. The anchor should be capable of resisting the maximum tensile load of the guy wire, including both the dead load of the tension of the guy wire and the maximum possible live load due to environmental forces, such as the wind. Since the guy wire exerts its force at an angle, the anchor has both vertical and horizontal forces on it, and the anchor relies on the lateral shear strength of the soil to hold it in place. Several types of anchors can be used to attach guys to the ground, for example, dead man anchors, expanding anchors, grouted anchors, and screw anchors. Screw anchors are also known as screw piles or helical piles.

Helical piles are a cost-effective alternative to other ground guy anchor types. Helical piles are preferred because of the speed and ease at which they can be installed. Generally, helical piles are rotated such that load bearing helical plates at the lower end of the pile effectively screw the pile into the soil to a depth that can bear the load. In order to maintain the guy wire at the 45 degree angle, helical piles used to anchor guy wires are screwed into the ground at the same angle as the guy, i.e., at 45 degrees. The upper end of the helical pile has an eyelet to attach the guy wire to the helical pile.

The area above and below the ground occupied by the anchor determines the land use rights the owner of a free standing structure needs to secure in order to install, anchor and stabilize the free standing structure. Such rights are also known in the industry as a right-of-way. As noted, when using helical piles 14 as the guy wire anchor, the helical piles are screwed into the ground at the same 45 degree angle as the guy wire, which increases the distance from the free standing structure as identified by 14*a* in FIG. 2. This increased distance is the length of the helical pile under the ground. Thus, using helical piles to anchor guy wires as described above increases the size of the right of way that may be needed to stabilize free standing structures. This becomes costly when considering that in many cases multiple guy wires and corresponding guy wire anchors are employed to stabilize a free standing structure. For example, in FIG. 2, a free standing structure 12 has three guy wires 10 extending from the structure to the ground, where the three guy wires 10 are positioned at 120 degree intervals. The guy wires 10 are anchored to the ground with helical piles 14. In such an example, the owner of the free standing structure has to either purchase, lease or otherwise secure a right-of-way, which is represented by the dotted line around the perimeter of the free standing structure, including the area underground occupied by the helical pile.

SUMMARY

The present disclosure provides guy wire anchoring brackets, guy wire anchoring kits, and guy wire anchoring systems that effectively reduce the land right-of-way needed to anchor guy wires attached to, for example, free standing structures. The guy wire anchoring brackets interconnect one or more helical piles in an angular relationship so that they act in unison to resist loading and reduce the real estate needed to anchor guy wires. The guy wire anchoring kits includes at least one pile connector assembly and the guy wire anchoring bracket capable of interconnecting one or more helical piles in an angular relationship so that they act in unison to resist loading. The guy wire anchoring systems include the guy wire anchoring bracket, one or more helical piles and one or more pile connector assemblies that connect one or more helical piles to the guy wire anchoring bracket.

In an exemplary configuration, the guy wire anchoring bracket includes, a vertical pile anchor member secured to an offset arm at an angle relative to the vertical pile anchor member, an eye brace connected to the vertical pile anchor member and the offset arm, and at least one offset pile anchor member is secured to the offset arm. In another configuration, the guy wire anchoring bracket includes a vertical pile anchor member secured to an offset arm at an angle relative to the vertical pile anchor member, a first aperture in the offset arm used to connect the offset arm to a guy wire, and a second aperture in the offset arm used to connect the offset arm to at least one offset helical pile.

In an exemplary configuration the guy wire anchoring kit includes a guy wire anchoring bracket and at least one guy wire connector assembly. The guy wire anchoring bracket in one configuration has a vertical pile anchor member secured to an offset arm at an angle relative to the vertical pile anchor member, an eye brace connected to the vertical pile anchor member and the offset arm, and at least one offset pile anchor member secured to the offset arm. In another configuration, the guy wire anchoring bracket includes a vertical pile anchor member secured to an offset arm at an angle relative to the vertical pile anchor member, a first aperture in the offset arm used to connect the offset arm to a guy wire, and a second aperture in the offset arm used to connect the offset arm to at least one offset helical pile. The at least one guy wire connector assembly includes a pile cap used for securing the connector assembly to a helical pile, and a pile connecting rod capable of being connected to the pile cap and to an offset pile anchor member secured to the offset arm.

In an exemplary configuration, the guy wire anchoring system includes, a guy wire anchoring bracket having a vertical pile anchor member secured to an offset arm at an angle relative to the vertical pile anchor member, an eye brace connected to the vertical pile anchor member and the offset arm, at least one offset pile anchor member secured to the offset arm, at least one helical pile, and at least one guy wire connector assembly connecting the at least one helical pile to the guy wire anchoring bracket. In another configuration, the guy wire anchoring bracket includes a vertical pile anchor member secured to an offset arm at an angle relative to the vertical pile anchor member, a first aperture in the offset arm used to connect the offset arm to a guy wire, and a second aperture in the offset arm used to connect the offset arm to at least one offset helical pile.

BRIEF DESCRIPTION OF THE DRAWINGS

The figures depict embodiments or configurations for purposes of illustration only. One skilled in the art will readily recognize from the following description that alternative embodiments or configuration of the structures illustrated herein may be employed without departing from the principles described herein, wherein.

DETAILED DESCRIPTION

The present disclosure provides guy wire anchoring brackets, guy wire anchoring kits, and guy wire anchoring systems that effectively reduce the land right-of-way needed to anchor guy wires attached to free standing structures. The guy wire anchoring brackets interconnect one or more helical piles in an angular relationship so that they act in unison to resist loading and reduce the real estate needed to anchor guy wires. The guy wire anchoring kits includes at least one pile connector assembly and at least one guy wire anchoring bracket. The guy wire anchoring systems include the guy wire anchoring bracket, one or more helical piles and one or more pile connector assemblies that connect the one or more helical piles to the guy wire anchoring bracket. The present disclosure also includes a method for anchoring guy wires used to stabilize free standing structures while reducing land use rights needed to anchor the guy wires.

Figure 1:
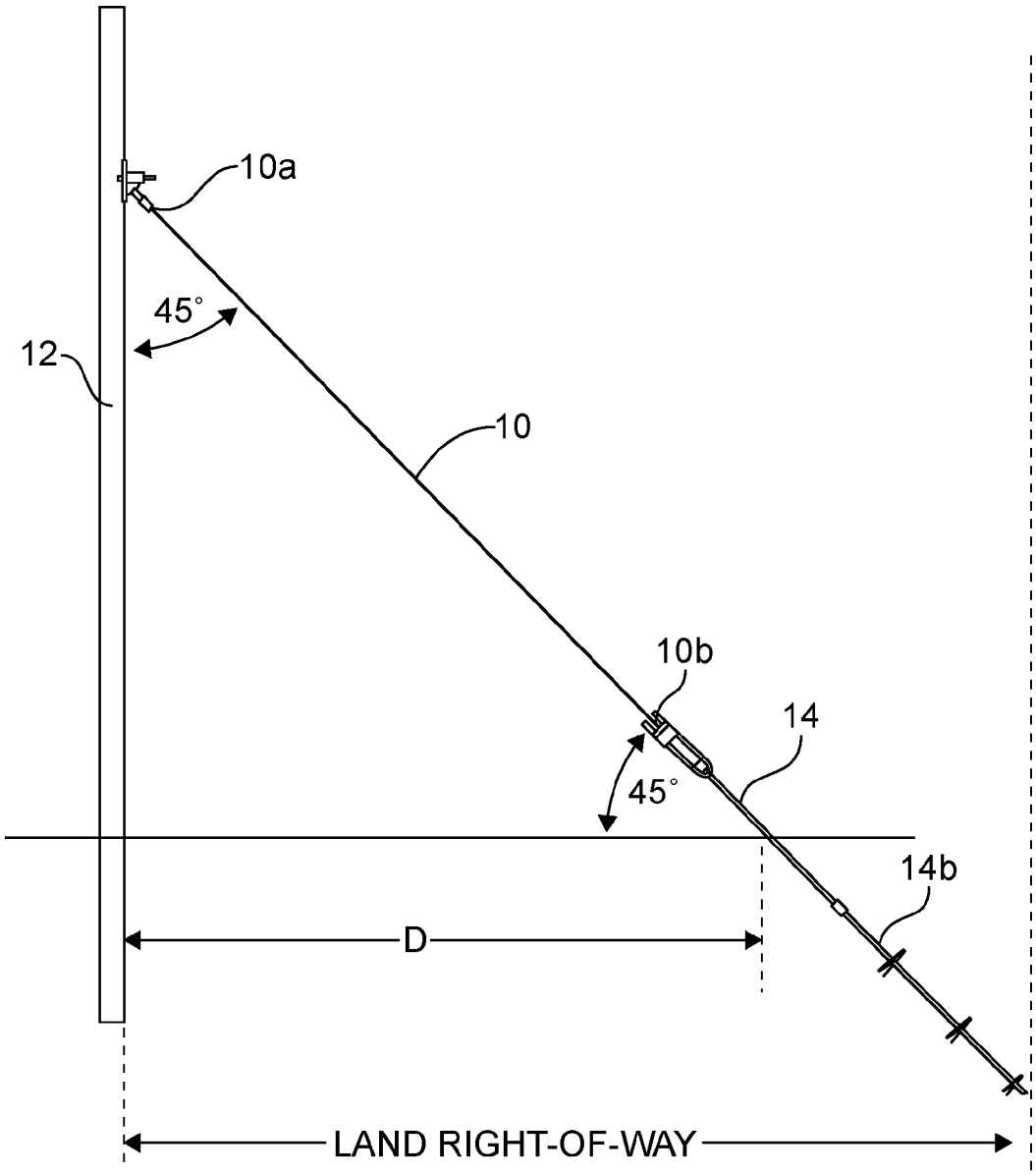
PRIOR ART FIG. 1
FIG. 1 is a side view of a conventional technique for stabilizing a free standing structure with a guy wire anchored to the ground using a helical pile.
Figure 2:
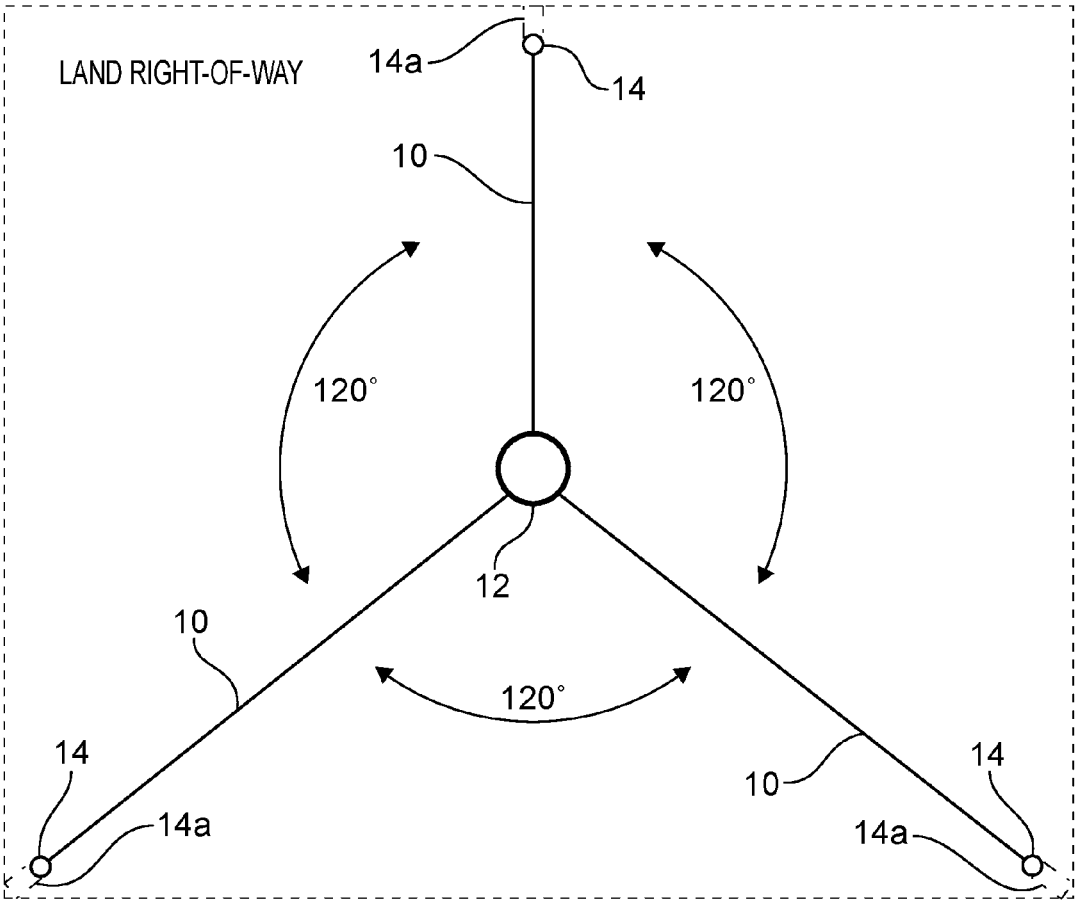
PRIOR ART FIG. 2
FIG. 2 is an overhead view of a ground based free standing structure with three guy wires used to stabilize the structure, and illustrating the land area needed for a right-of-way.
Figure 3:
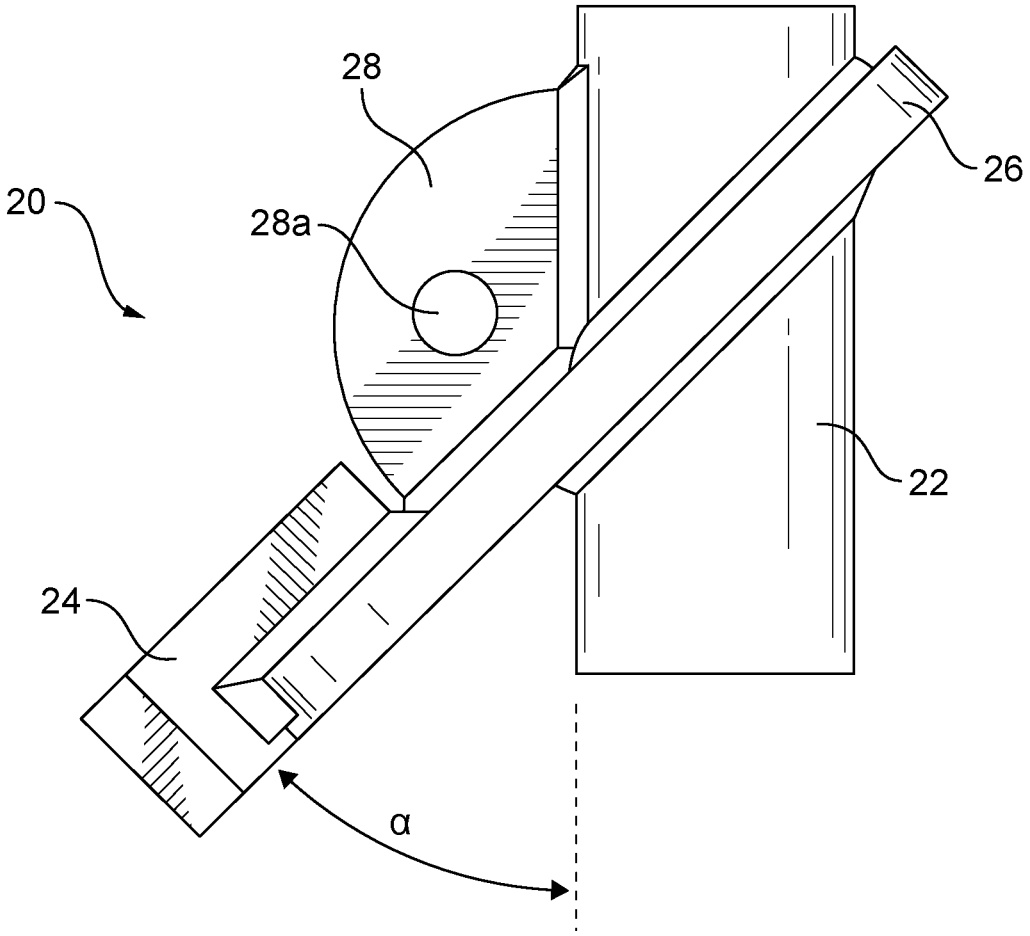
FIG. 3 is a side view of an exemplary configuration of a guy wire anchoring bracket according to the present disclosure.
Figure 5:
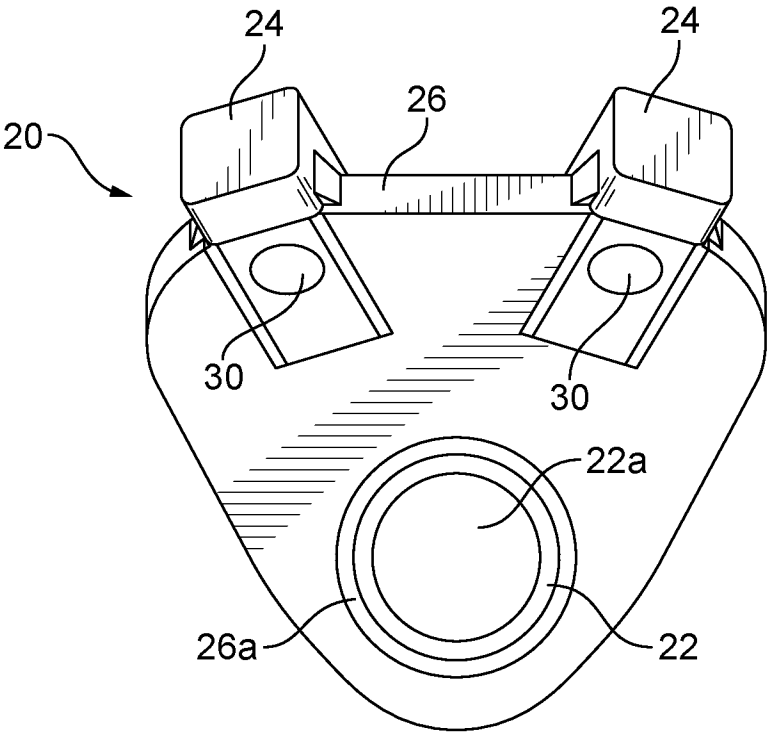
FIG. 5 is a bottom perspective view of the a guy wire anchoring bracket of FIG. 3.
Figure 4:
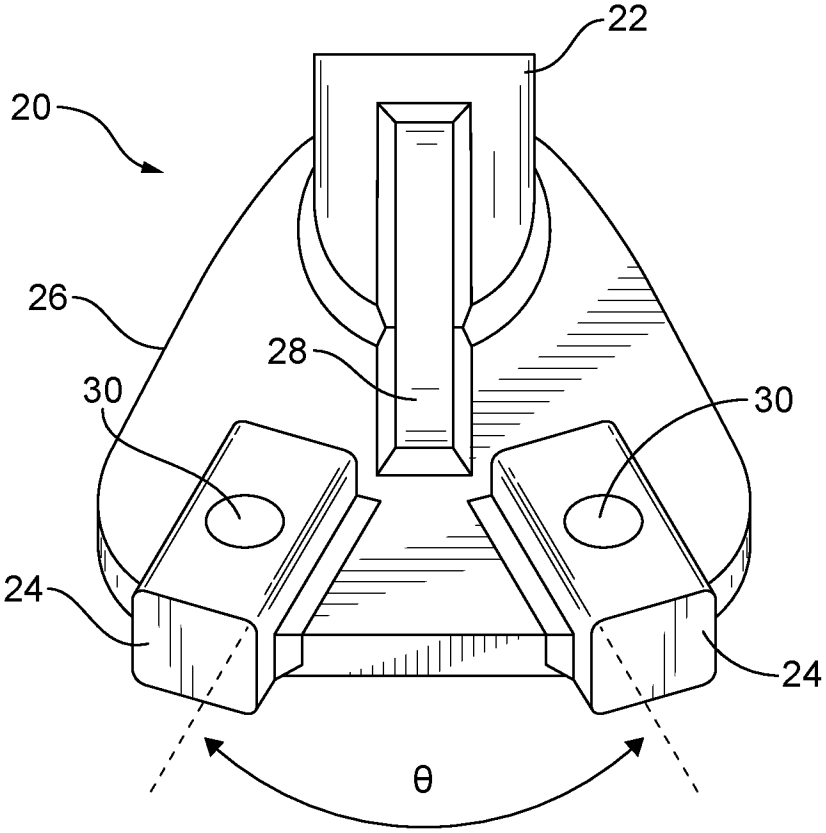
FIG. 4 is a front perspective view of the a guy wire anchoring bracket of FIG. 3.

Referring now to FIGS. 3-5, an exemplary configuration of a guy wire anchoring bracket 20 according to the present disclosure is shown. In this exemplary configuration, the guy wire anchoring bracket 20 includes a vertical pile anchor member 22, at least one offset pile anchor member 24 secured to an offset arm 26, and an eye brace 28, which in this exemplary configuration is secured to the vertical pile anchor member 22 and to the offset arm 26. However, one skilled in the art can readily appreciate that the eye brace 28 can be connected to the vertical pile anchor member 22, or to the offset arm 26. The components that make up the guy wire anchoring bracket 20 can be made from steel or a galvanized steel. However, other known metals and other materials, such as Ductile iron, that have the strength to withstand the loads the guy wire anchoring bracket 20 will need to withstand are also contemplated.

The vertical pile anchor member 22 shown is a tube shaped structure configured to receive a top end of a helical pile, as will be described in more detail below. While shown as a tubular shaped structure, the vertical pile anchor member 22 may have any shape that conforms to the shape of helical piles, such as a square or rectangular shape. The offset arm 26 has an aperture 26*a* configured to receive the vertical pile anchor member 22, as shown in FIGS. 3 and 5. The offset arm 26 is positioned at an angle "α" relative to the vertical pile anchor member 22, and is secured in place by, for example, a welded joint. However, other known techniques for attaching the offset arm 26 to the vertical pile anchor member 22 may be used, such as by nut and bolt. Further, the vertical pile anchor member 22 and offset arm 26 may be made as a unitary structure. The angle "α" can range from between about 20 degrees and about 65 degrees. For example, the angle "α" can be 45 degrees.

The eye brace 28 acts to further reinforce the connection between the vertical pile anchor member 22 and the offset arm 26, and can be integrally formed or molded into, or welded to the vertical pile anchor member 22 and the offset arm 26. However, other known techniques to secure the eye brace 28 to the vertical pile anchor member 22 and the offset arm 26 may be used. The eye brace 28 has an eyelet 28*a* that is used for securing a guy wire to the guy wire anchoring bracket 20.

Referring to FIGS. 4 and 5, in this exemplary configuration, the at least one offset pile anchor member 24 includes two offset pile anchor members 24. The two offset pile anchor members 24 are attached to the offset arm 26 at an angle "θ" relative to each other. The angle "θ" can range from about 10 degrees to about 90 degrees. For example, angle "θ" can be 45 degrees. The offset pile anchor members 24 can be integrally formed or molded into, or they can be welded to the offset arm 26. However, other known techniques for securing the offset pile anchor members 24 to the offset arm 26 may be used, such as by nut and bolt. Each offset pile anchor member 24 includes an aperture 30 that extends through the offset arm 26 for connection to a helical pile, as will be described in more detail below. While the exemplary configuration of FIGS. 4 and 5 show two offset pile anchor members 24, the number of offset pile anchor members used as contemplated by the present disclosure is at least one and may include a plurality of offset pile anchor members 24.

Figure 6:
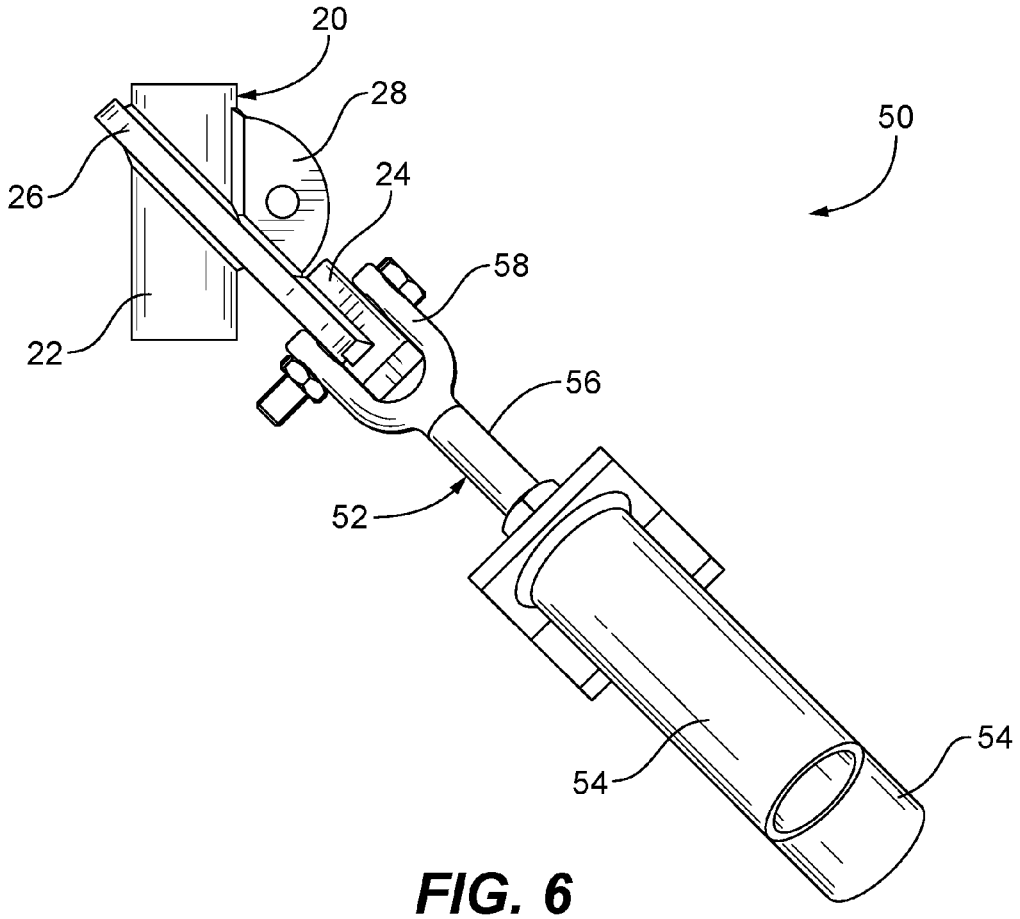
FIG. 6 is a side view of an exemplary configuration of a guy wire anchoring kit according to the present disclosure.
Figure 8:
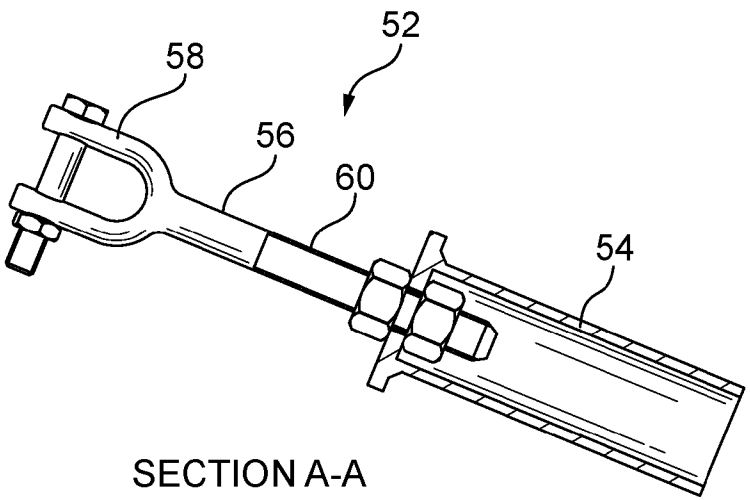
FIG. 8 is a cross-sectional view of a portion of the guy wire anchoring kit of FIG. 6 taken along section A-A.
Figure 7:
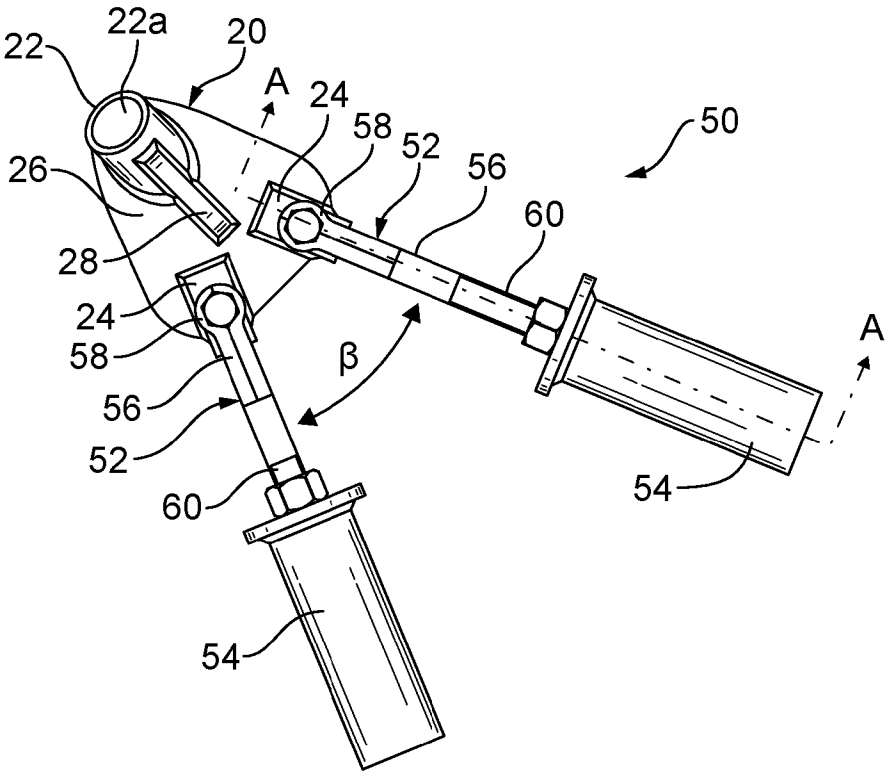
FIG. 7 is a top plan view of the guy wire anchoring kit of FIG. 6.
Figure 10:
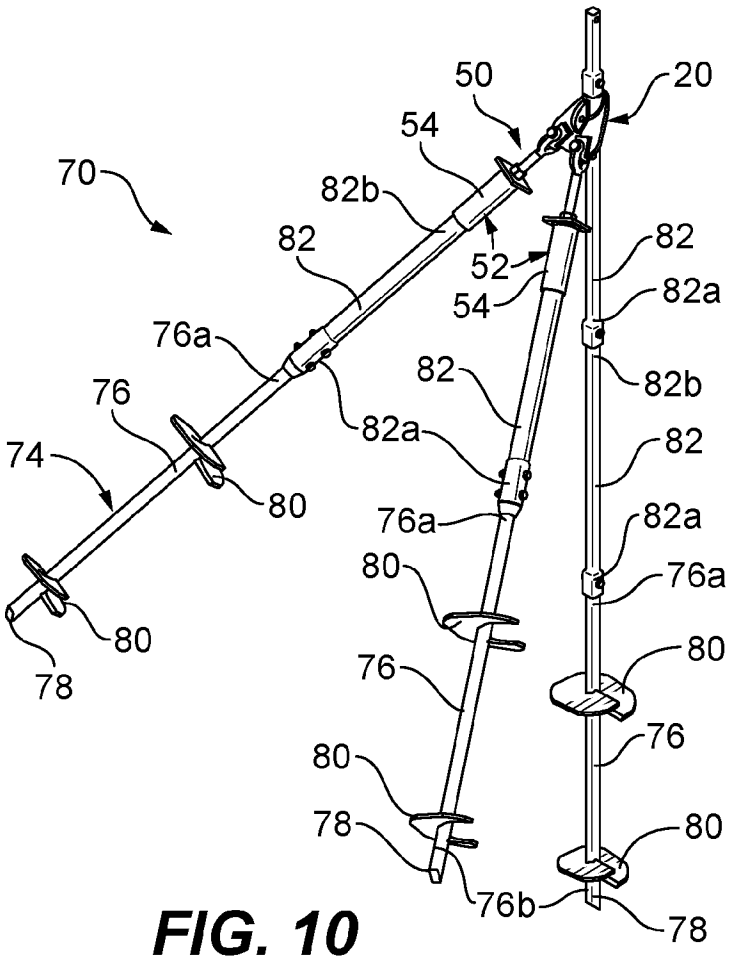
FIG. 10 is a perspective view of the guy wire anchoring system of FIG. 9.
Figure 9:
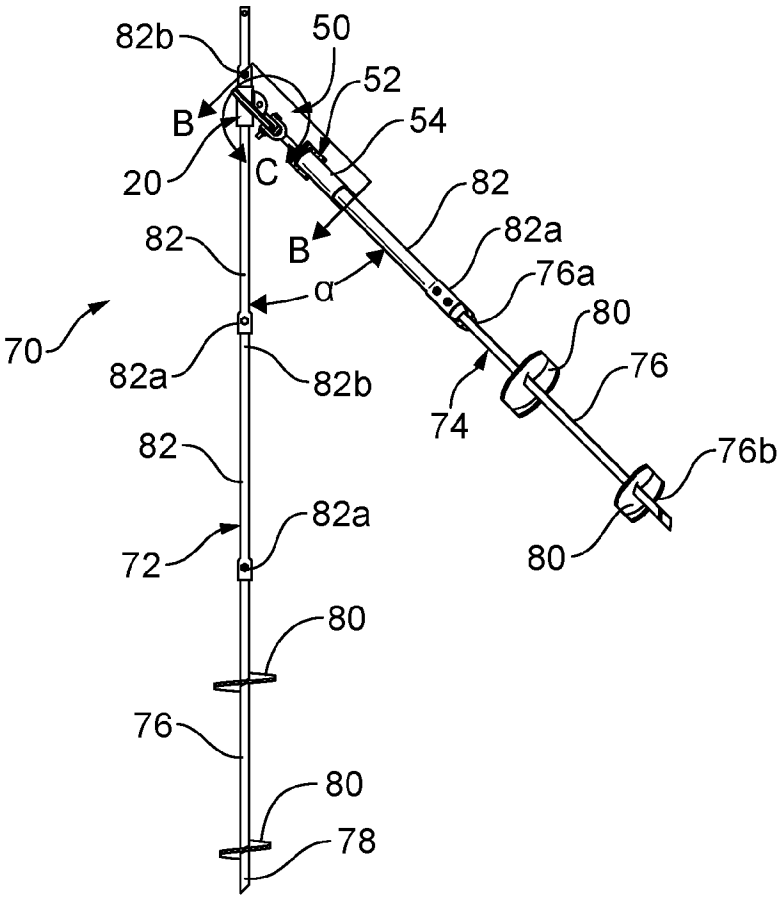
FIG. 9 is a side view of an exemplary configuration of a guy wire anchoring system according to the present disclosure.
Figure 11:
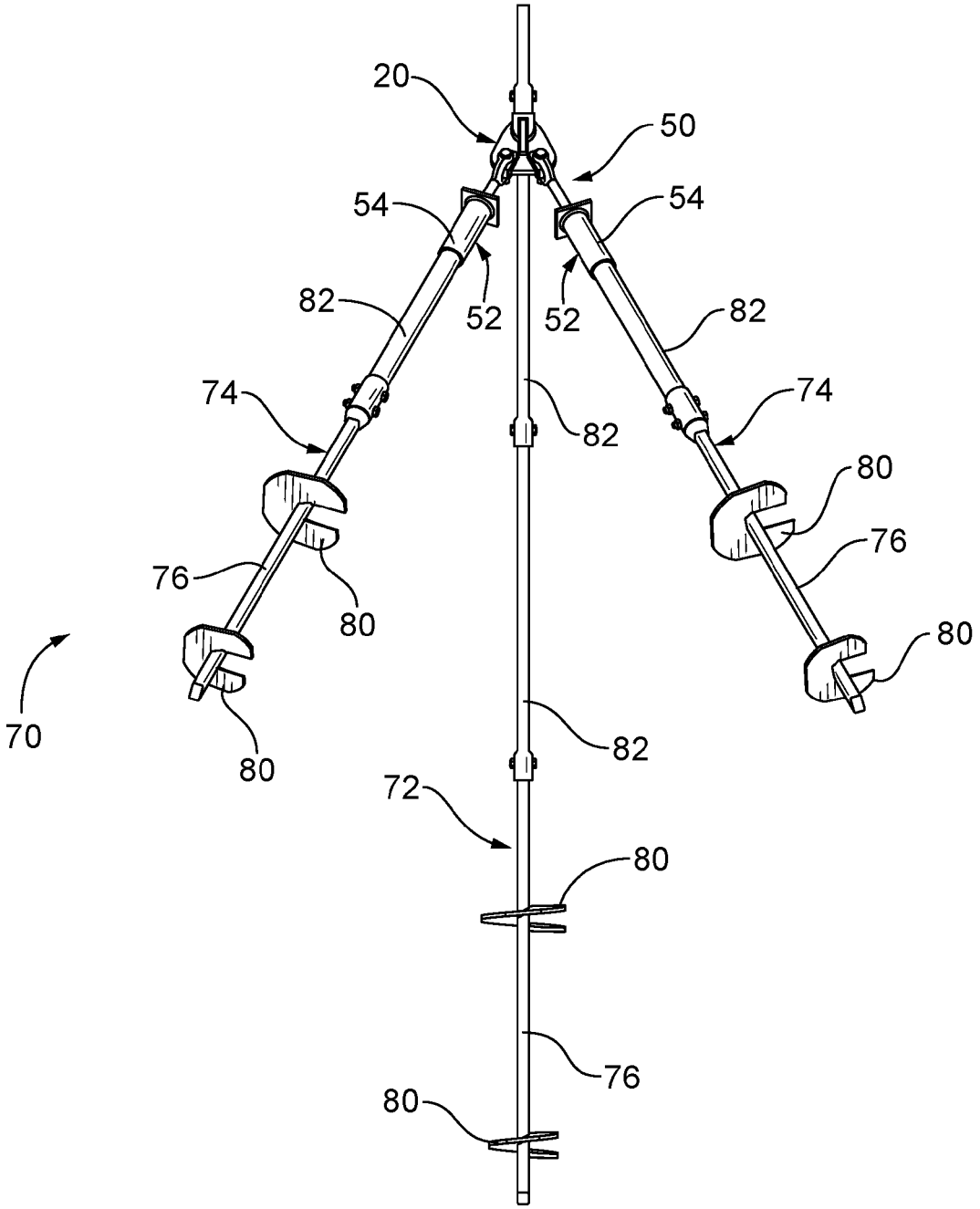
FIG. 11 is a front elevation view of the guy wire anchoring system of FIG. 9.

Turning to FIGS. 6-8, an exemplary configuration of a guy wire anchoring kit is shown. In this exemplary configuration, the guy wire anchoring kit 50 includes a guy wire anchoring bracket 20 (described above) and at least one pile connector assembly 52. The pile connector assembly 52 includes at least one helical pile cap 54, and at least one pile connecting rod 56. In the exemplary configuration shown, there are two pile connector assemblies 52.

In this exemplary configuration, the pile connecting rod 56 has a clevis 58 at one end and a threaded section 60 at the other end. The clevis 58 is used to attach the pile connector assembly 52 to a corresponding offset pile anchor member 24 on the guy wire anchoring bracket 20. The clevis 58 is attached to the offset pile anchor member 24 by inserting a bolt through one side of the clevis, passing the bolt through aperture 30 in offset pile anchor member 24 and offset arm 26, and extending the bolt through the other side of the clevis, and then attaching a nut. Using a clevis 58 permits easy connection between the pile cap 54 and the guy wire anchoring bracket 20 during installation. Further, in the exemplary configuration of the guy wire anchoring bracket 20 with two offset pile anchor members 24, the two offset pile anchor members are in a fixed angular relationship "θ" relative to each other, as described above. Using the clevis 58 permits adjustment of the angle between two offset helical piles to an angle "β", which may be different than angle "θ". The angle "β" can range from about 10 degrees to about 90 degrees. For example, the angle "β" can be 45 degrees.

The threaded end 60 of the pile connecting rod 56 is attached to the pile cap 54 using a pair of nuts as shown in FIG. 8. The threaded end 60 of the connecting rod 56 permits adjustment of the pile cap 54 relative to the guy wire anchoring bracket 20 during installation, and if necessary to tighten the connection between the connecting rod 56 and the pile cap 54 over time.

Referring now to FIGS. 9-13, an exemplary configuration of a guy wire anchoring system is shown. In this exemplary configuration, the guy wire anchoring system 70 includes a guy wire anchoring bracket 20 (described above), at least one pile connector assembly 52 (described above) and at least two helical piles, where one helical pile 72 is vertically oriented, and one or more helical piles 74 are offset from the vertical helical pile 72, as shown. As noted above, the angle "α" between the vertically oriented helical pile 72 and the one or more offset helical piles 74 is defined at least in part by the angular relationship between the vertical pile anchor member 22 and the offset arm 26. The angle "α" can range from about 20 degrees to about 65 degrees. As an example, the angle "α" can be 45 degrees.

A helical pile is typically made of galvanized straight steel square or round shafts sequentially joined together. The bottom most piece of a helical pile is known as the lead 76, which has a lead head portion 76*a* and a lead end portion 76*b*. The lead end portion 76*b* is configured to first penetrate the soil, and terminates at a pointed tip 78 (seen in FIGS. 9-11). The lead 76 typically has one or more spaced apart load bearing helical plates 80 arranged on the lead shaft, typically in the lead end portion, to penetrate the soil. The load bearing helical plates 80 on the lead may have the same diameter, or the load bearing helical plates may have different diameters that are in, for example, a tapered arrangement. For example, the tapered arrangement may be such that the smallest diameter load bearing helical plate is closest to the lead tip 78, and the largest load bearing helical plate is at a distance away from the lead tip. The load bearing helical plates 80 on the lead 76 are spaced apart at a distance sufficient to promote individual plate load bearing capacity, as is known in the art. The diameter of the load bearing helical plates 80 in conventional helical piles may range from between about 6 inches and about 16 inches depending upon the load the pile is to carry. As noted above, helical piles are installed by applying torque to the shaft at the lead head 76*a* that causes the load bearing helical plates to rotate and screw into the soil with minimal disruption to the surrounding soil. As the lead 76 penetrates the soil, one or more extensions 82 (seen in FIGS. 9-11) may have to be added to the pile 72 or 74 so that the pile can achieve the desired depth and load capacity. The extensions 82 may be fabricated from traditional straight steel square or round shafts and have an extension end portion 82*a* and an extension head portion 82*b* that are configured to connect to a lead head portion 76*a* and/or another extension 82, typically with a nut and bolt. The extensions 82 may have load bearing helical plates spaced apart at a distance sufficient to promote individual plate load bearing capacity. The diameter of the load bearing helical plates in conventional helical pile extensions may range from between about 12 inches and about 16 inches depending upon the load the pile is to carry.

Typically, the load bearing plates on extension 82 are the same diameter as the largest load bearing helical plate on the lead 76.

Figure 13:
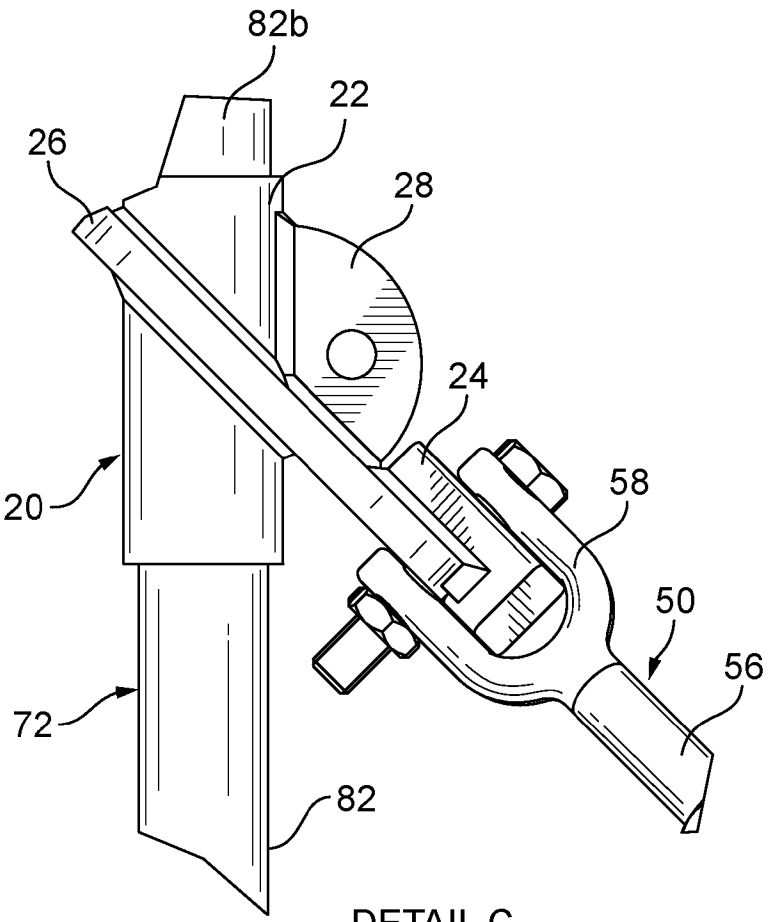
FIG. 13 is a side view of the portion of the guy wire anchoring system taken along detail C of FIG. 9.
Figure 12:
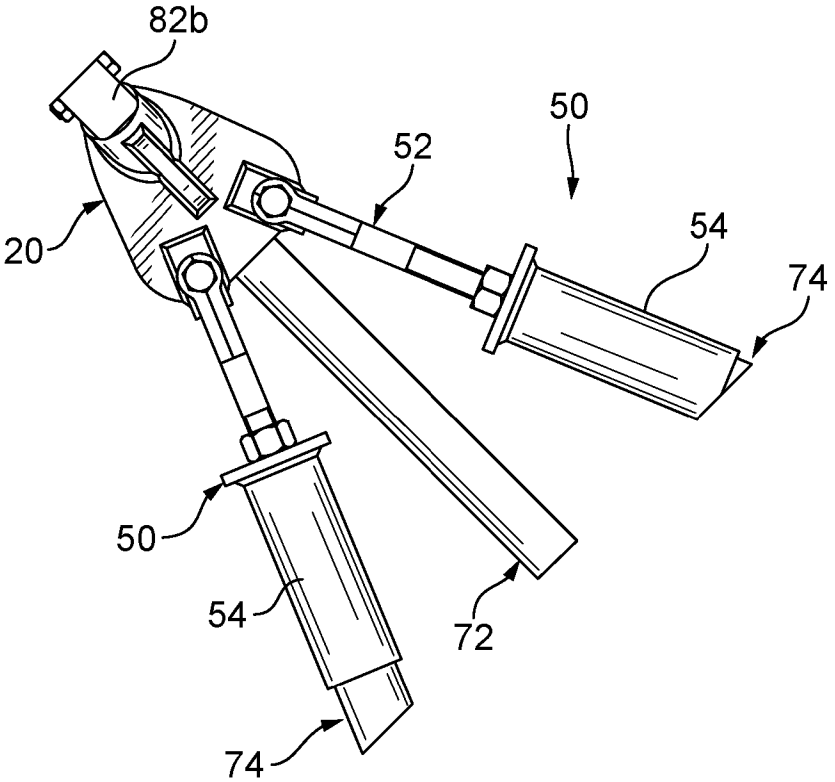
FIG. 12 is a top plan view of a portion of the guy wire anchoring system taken along section B-B of FIG. 9.

Referring to FIGS. 12 and 13, the vertical helical pile 72 is connected to the guy wire anchoring bracket 20 by inserting the top end of the vertical helical pile 72 (either lead end 76*a* or extension end 82*b*) into the aperture 22*a* (seen in FIG. 5) in the vertical pile anchor member 22. The fit between the vertical helical pile 72 and the vertical pile anchor member 22 is a loose fit so that the vertical helical pile 72 can be adjusted after installation. The arrangement of the vertical helical pile 72 and the offset helical piles 74 maintains the position of the guy wire anchoring bracket 20 relative to the vertical helical pile 72. Tension of the guy wire when applied to the guy wire anchoring bracket 20 further secures the position of the guy wire anchoring bracket 20 relative to the vertical helical pile 72.

The number of offset pile anchor members 24 on the guy wire anchoring bracket 20 determines the number of pile connector assemblies 52 and the number of offset helical piles 74 to be used with the system 70. For example, in the configuration shown in FIGS. 9-13, the guy wire anchoring bracket 20 has two offset pile anchor members 24. Thus, two pile connector assemblies 52 and two offset helical piles 74 are included in this configuration of the guy wire anchoring system 70. As described above, the pile connector assemblies 52 are secured to the guy wire anchoring bracket 20 via clevis 58, and to each offset helical pile 74 via pile cap 54. Clevis 58 is secured to the offset pile anchor member 24 via nut and bolt, and the pile cap 54 is secured to the top end of the offset helical pile 74 by a compression fit. Alternatively or in addition to the compression fit, a nut and bolt or other suitable fastening system can be used to secure the pile cap 54 to the top end of the offset helical pile 74.

Referring now to FIGS. 14-17, other exemplary configurations of a guy wire anchoring bracket 20, a guy wire anchoring kit 50, and a guy wire anchoring system 70 are shown. The guy wire anchoring bracket 20 according to this exemplary configuration includes a vertical pile anchor member 122 and an offset arm 126. As described above, the components that make up the guy wire anchoring bracket 20 can be made from steel or a galvanized steel. However, other known metals and other materials that have the strength to withstand the loads the guy wire anchoring bracket 20 will need to withstand are also contemplated.

Figure 14:
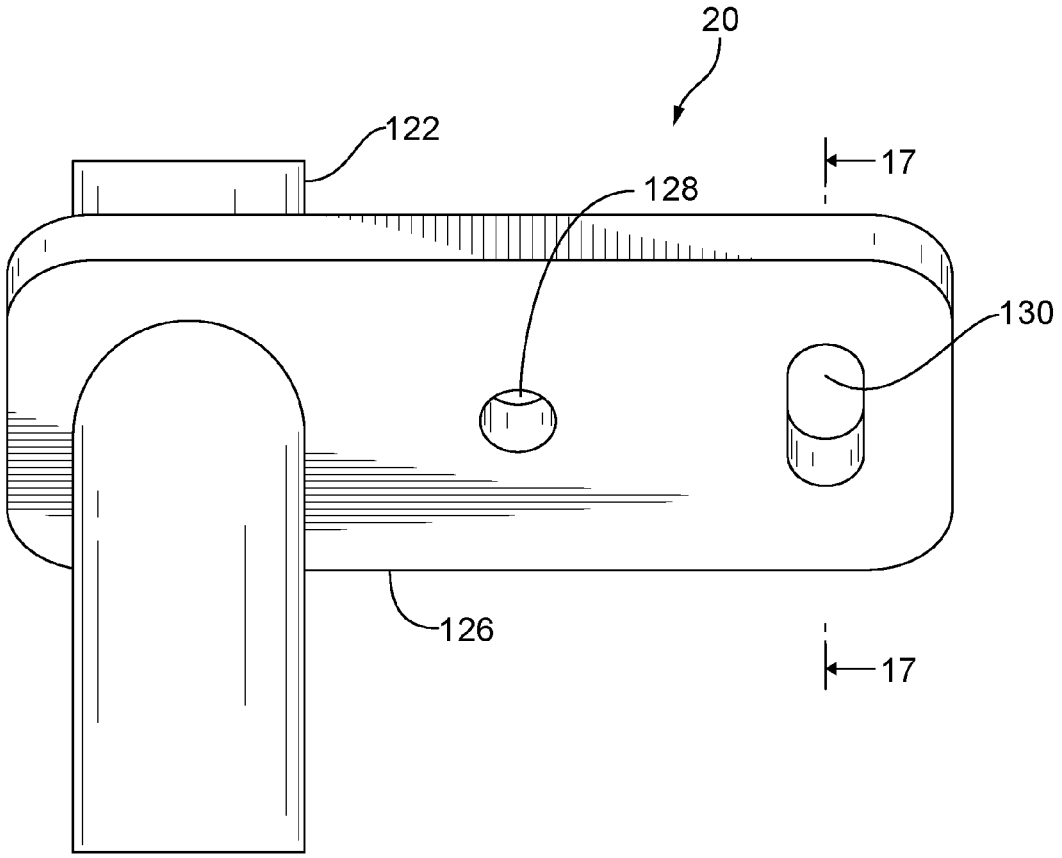
FIG. 14 is a first side view of another exemplary configuration of a guy wire anchoring bracket according to the present disclosure.
Figure 15:
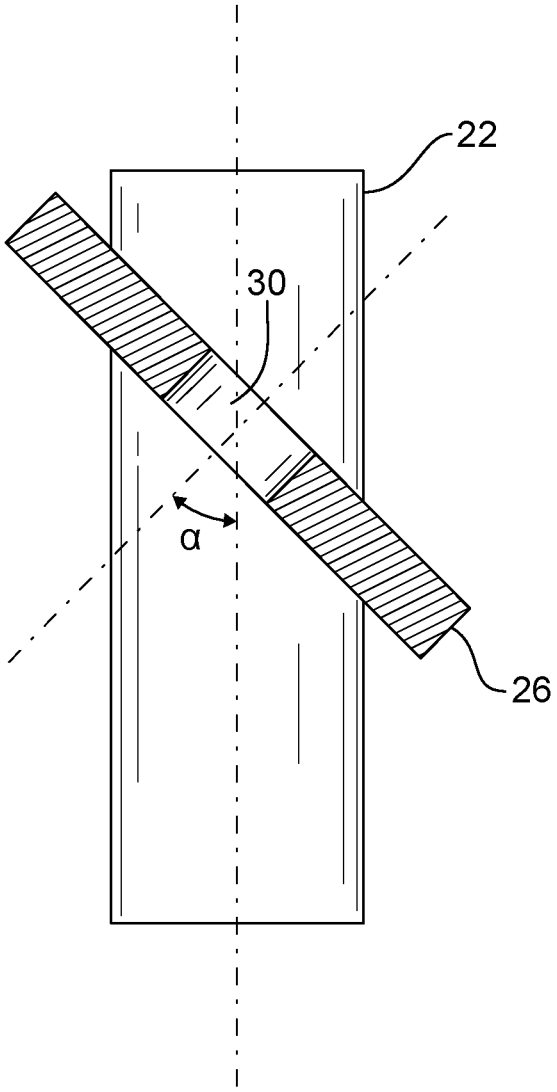
FIG. 15 is a second side view of the guy wire anchoring bracket of FIG. 14.

The vertical pile anchor member 122 shown is a tube shaped structure configured to receive a top end of a helical pile, and is similar to the vertical pile anchor member 22 described above. The offset arm 126 has an aperture configured to receive the vertical pile anchor member 122, as shown in FIGS. 14 and 15, and the offset arm 126 is secured to the vertical pile anchor member 122 by for example a weld joint. However, other known techniques for securing the offset arm 126 to the vertical pile anchor member 122 may be used, such as by nut and bolt, or the offset arm 126 can be integrally molded or formed together with the vertical pile anchor member 122. When securing the offset arm 126 to (or forming into) the vertical pile anchor member 122, the offset arm is positioned at an angle "α", seen in FIG. 17, relative to the vertical pile anchor member 122. The angle "α" can range from about 20 degrees to about 65 degrees. For example, the angle "α" can be 45 degrees. The offset arm 126 includes a guy wire connection aperture 128 used to secure a guy wire to the guy wire anchoring bracket 20, using known techniques. The offset arm 126 also includes a helical pile connection aperture 130 used to secure an offset helical pile 74 to the guy wire anchoring bracket 20. The helical pile connection aperture 130 can be an elongated opening to permit easy connection to the offset helical pile, as described below.

Figure 16:
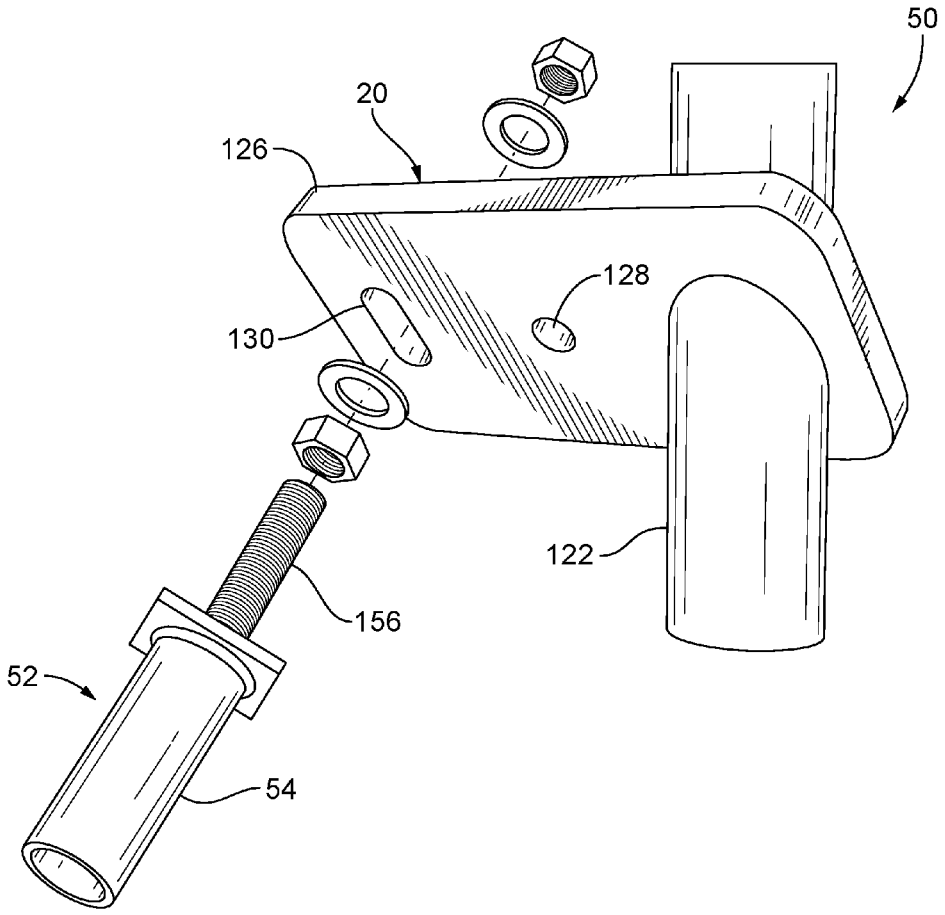
FIG. 16 is a perspective view of the guy wire anchoring bracket of FIG. 14 and another exemplary configuration of a pile connector assembly according to the present disclosure.

Turning to FIG. 16, another exemplary configuration of a guy wire anchoring kit is shown. In this exemplary configuration, the guy wire anchoring kit 50 includes a guy wire anchoring bracket 20, described above with reference to FIGS. 14 and 15, and at least one pile connector assembly 52 similar to the pile connector assembly described above. The pile connector assembly 52 includes at least one helical pile cap 54, and at least one threaded pile connecting rod 156. One end of the pile connecting rod 156 is attached to the pile cap 54 using a pair of nuts similar to the configuration shown in FIG. 8. This threaded end of the connecting rod 156 permits adjustment of the pile cap 54 relative to the guy wire anchoring bracket 20 during installation, and if necessary to tighten the connection between the connecting rod 156 and the pile cap 54 over time. The free end of the pile connecting rod 156 can be inserted through helical pile connection aperture 130 and secured to the offset arm 126 via nuts and bolts, as seen in FIG. 16.

Figure 17:
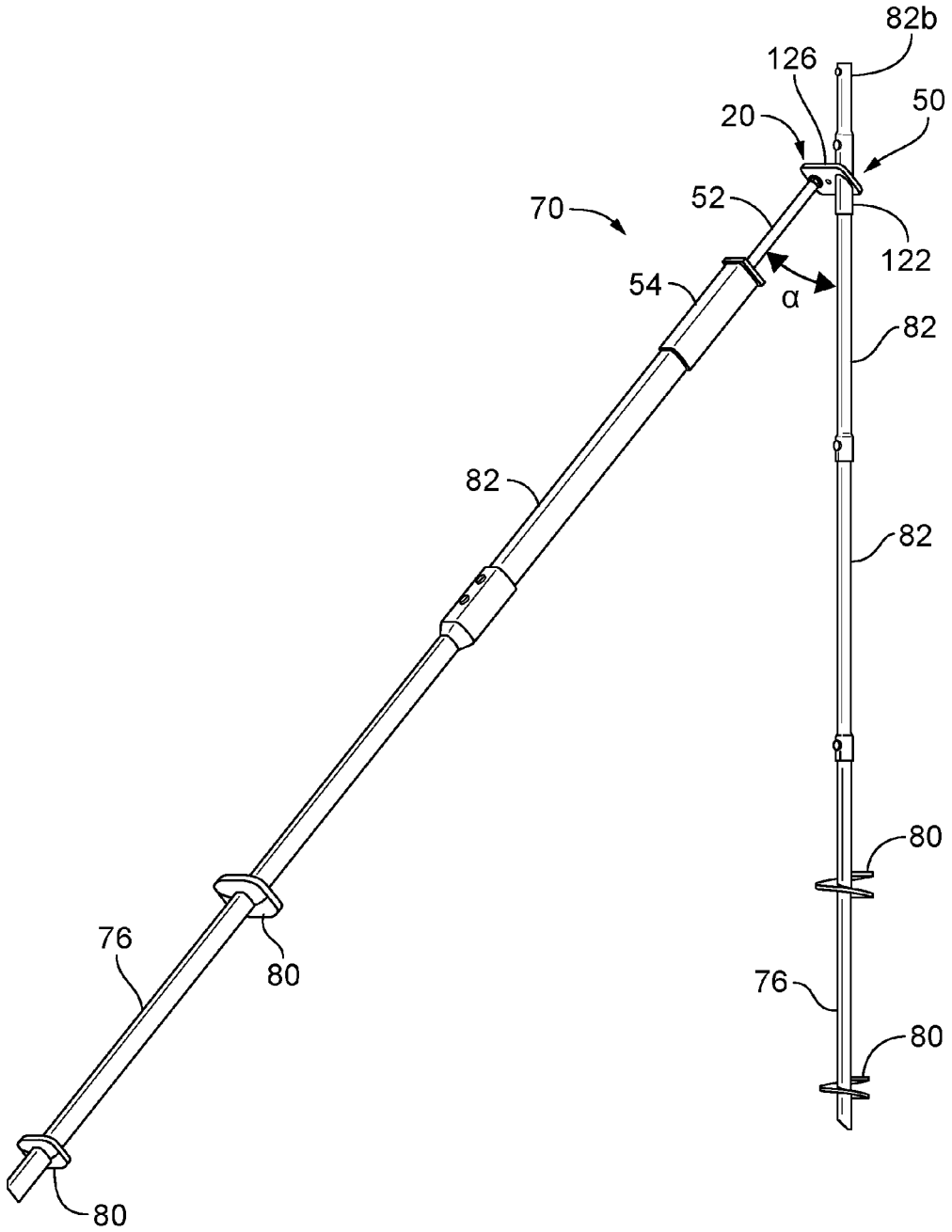
FIG. 17 is a side perspective view of another exemplary configuration of a guy wire anchoring system according to the present disclosure.

Turning to FIG. 17, another exemplary configuration of a guy wire anchoring system is shown. In this exemplary configuration, the guy wire anchoring system 70 includes a guy wire anchoring bracket 20 (described above), at least one pile connector assembly 52 (described above) and at least two helical piles, where one helical pile 72 is vertically oriented, and one or more helical piles 74 are offset from the vertical helical pile 72, as shown. As noted above, the angle "α" between the vertically oriented helical pile 72 and the one or more offset helical piles 74 is defined at least in part by the angular relationship between the vertical pile anchor member 122 and the offset arm 126. The angle "α" can range from about 20 degrees to about 65 degrees. As an example, the angle "α" can be 45 degrees.

Figure 18:
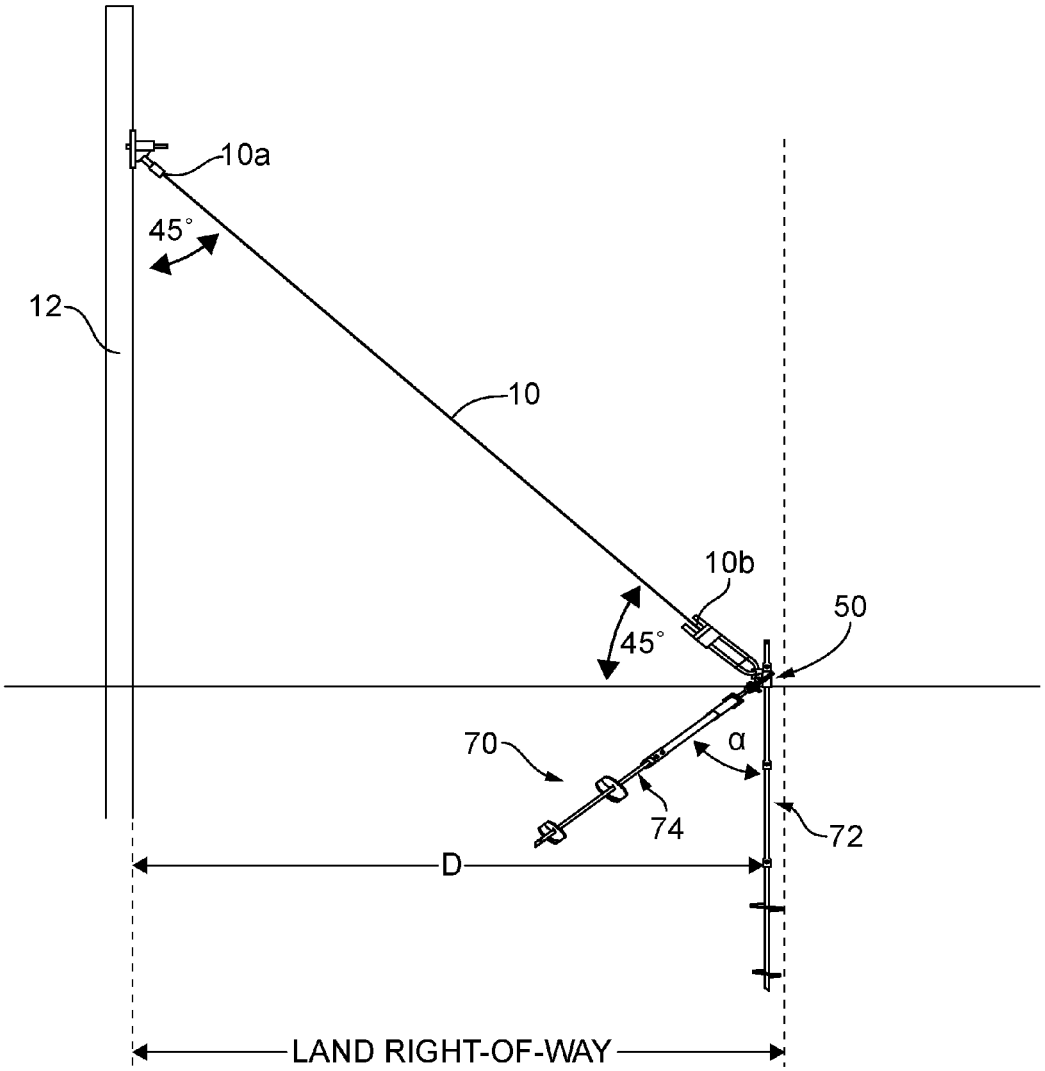
FIG. 18 is a side view of a free standing structure with a guy wire anchored to the ground using the guy wire anchoring system of FIG. 9.

Referring to FIG. 18, to anchor a guy wire to the ground using the guy wire anchoring system 70, each helical pile is rotated (or screwed) into the ground to a desired depth. The vertical helical pile 72 is driven into the ground at an angle that is substantially parallel to the vertical axis of the free standing structure 12. Then, one or more offset helical piles 74 are driven into the ground in a direction towards the free standing structure, at the angle "α" relative to the vertical helical pile 72, and in position to connect to the guy wire anchoring bracket 20. The vertical pile anchor member 22 or 122 (seen in FIG. 3 or FIG. 14) of the guy wire anchoring bracket 20 is inserted over the top end of the vertical helical pile 72. Pile connector assemblies 52, (seen in FIG. 6 or FIG. 16), are attached to the top end of each offset helical pile 74 via pile cap 54. When using the guy wire anchoring bracket of FIG. 3, the clevis 58 of each pile connector assembly 52 is connected to a corresponding offset pile anchor member 24 of the guy wire anchoring bracket 20, via, e.g., nut and bolt (seen in FIG. 3). Adjustments to the pile connector assemblies 52 can be made by adjusting the clevis 58 connections, and by adjusting the connection between the threaded end 60 of the pile connecting rod 56 and the pile cap 54, as described above. When using the guy wire anchoring bracket of FIG. 14, the free end of the pile connecting rod 156 is inserted through the aperture 130 in offset arm 126 and secured by nut and bolt, as seen in FIG. 16. Adjustments to the pile connector assembly 52 can be made by adjusting the connections at each end of the threaded connecting rod 156, e.g., by adjusting the connection between the threaded end of the pile connecting rod 156 and the pile cap 54, as described above.

Figure 19:
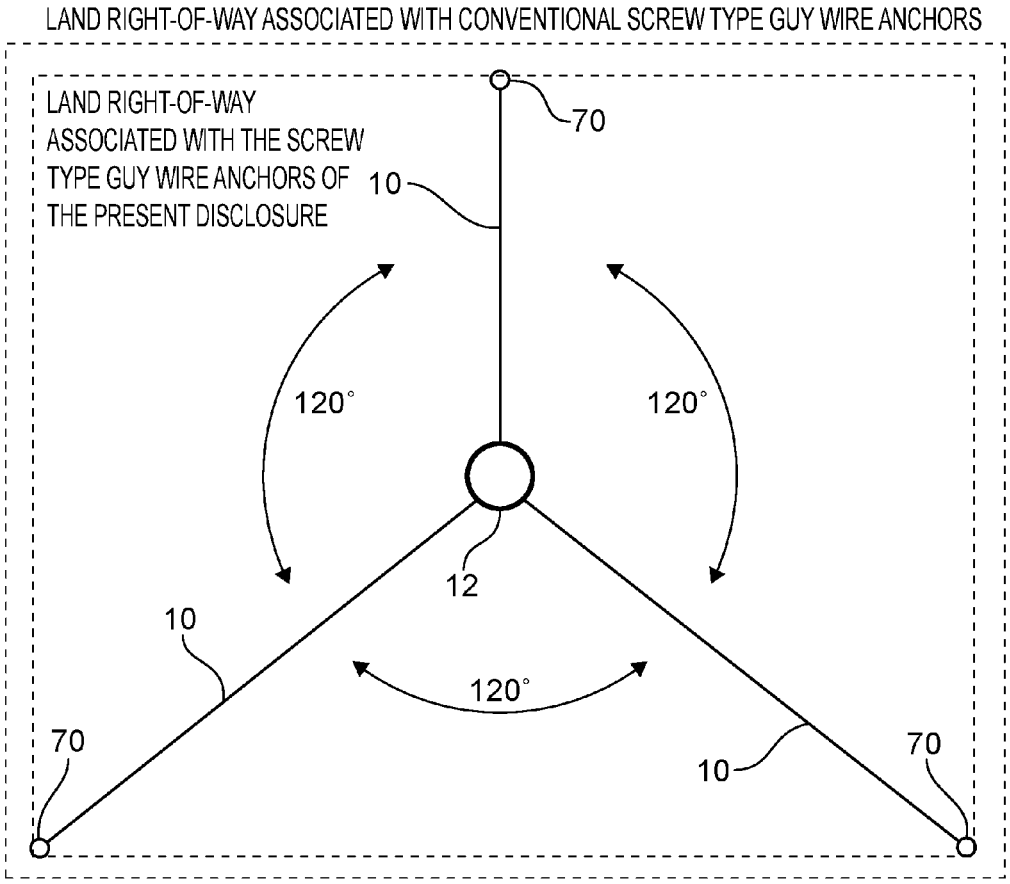
FIG. 19 is an overhead view of a ground based free standing structure with three guy wires used to stabilize the structure using the guy wire anchoring system of the present disclosure, and illustrating a reduced land area needed for a right-of-way.

Referring to FIG. 19, when the guy wire anchoring system 70 of the present disclosure is installed around the perimeter of a free standing structure 12, the offset helical piles are positioned toward the free standing structure 12 so that the real estate (i.e., the land right-of-way) needed to stabilize the free standing structure is reduced when compared to prior guy wire anchoring techniques used, as is demonstrated by the different dotted lines. Thus, the guy wire anchoring system 70 of the present disclosure facilitates a methodology for installing and interconnecting helical piles to anchor guy wires while reducing the land area needed to anchor such guy wires. The method includes driving a vertical helical pile into the ground at a vertical angle that is substantially parallel to the vertical axis of a free standing structure that the guy wire is to support. Driving one or more offset helical piles into the ground in a direction towards the free standing structure and at the angle "α" relative to the vertical helical pile. Positioning a guy wire anchoring bracket to an end of the vertical helical pile extending above the ground. Connecting an end of the one or more offset helical piles extending above the ground to the guy wire anchoring bracket. And, securing a guy wire to the guy wire anchoring bracket.

The guy wire anchoring bracket, guy wire anchoring kit and guy wire anchoring system according to the present disclosure effectively reduce the land right-of-way needed to anchor guy wires attached to free standing structures. The guy wire anchoring brackets interconnect one or more helical piles in an angular relationship so that they act in unison to resist loading and reduce the real estate needed to anchor guy wires. The guy wire anchoring kits includes a pile connector assembly and the guy wire anchoring bracket capable of interconnecting one or more helical piles in an angular relationship so that they act in unison to resist loading. The guy wire anchoring systems include the guy wire anchoring bracket, one or more helical piles and one or more pile connector assemblies that connect the one or more helical piles to the guy wire anchoring bracket. The particular configuration of the guy wire anchoring bracket used will depend upon the number of helical piles needed to carry the load of the guy wire, and the guy wire anchoring kit and system used will also depend upon the load of the guy wire. The helical piles, leads and extensions contemplated by the present disclosure may be any known helical piles, leads and extensions that can be driven into the soil and capable of supporting the load of the guy wire. The particular configuration of piles, leads and extensions used as well as the diameters of the load bearing helical plates and the perimeter shear helical plates will depend upon the load the piles are to bear, and the soil conditions. However, it will be understood that various modifications can be made to the configurations of the present disclosure herein without departing from the spirit and scope thereof. Therefore, the above description should not be construed as limiting the disclosure, but merely as embodiments or configurations thereof. Those skilled in the art will envision other modifications within the scope and spirit of the invention as defined by the claims appended hereto.

What is claimed is:

1. A guy wire anchoring bracket, comprising:

a vertical pile anchor member having a hollow center that is capable of receiving a shaft of a pile;

an offset arm having a first portion with an opening configured to receive the vertical pile anchor member such that when the vertical pile anchor member is positioned within the opening and secured to the offset arm, the offset arm is at an angle relative to the vertical pile anchor member and the vertical pile anchor member extends through the opening such that a first portion of the vertical pile anchor member extends from a first side of the offset arm and a second portion of the vertical pile anchor member extends from a second side of the offset arm, wherein the offset arm is secured to the vertical pile anchor member so that the offset arm is maintained at the angle relative to the vertical pile anchor member;

an eye brace having a first portion secured to the vertical pile anchor member and a second portion secured to the offset arm and an eyelet used for securing a guy wire to the eye brace; and at least one offset pile anchor member secured to a second portion of the offset arm and extending at least partially from the second portion of the offset arm, wherein the at least one offset pile anchor member is secured to the second portion of the offset arm so that the eyelet is located between the vertical pile anchor member and the at least one offset pile anchor, and wherein the portion of the at least one offset pile anchor member extending from the second portion of the offset arm is at substantially the same angle relative to the vertical pile anchor member as the angle between the offset arm and the vertical pile anchor member.

2. The guy wire anchoring bracket according to claim 1, wherein the angle of the offset arm relative to the vertical pile anchor member is in the range of about 20 degrees and about 65 degrees.

3. The guy wire anchoring bracket according to claim 1, wherein the angle of the offset arm relative to the vertical pile anchor member is 45 degrees.

4. The guy wire anchoring bracket according to claim 1, wherein the at least one offset pile anchor member secured to the offset arm comprises a pair of offset pile anchor members secured to the offset arm.

5. The guy wire anchoring bracket according to claim 4, wherein the pair of offset pile anchor members are secured to the offset arm at an angle relative to each other.

6. The guy wire anchoring bracket according to claim 5, wherein the angle the pair of offset pile anchor members are secured relative to each other is in the range of about 10degrees and about 90 degrees.

7. The guy wire anchoring bracket according to claim 5, wherein the angle between the pair of offset pile anchor members is 45 degrees.

8. A guy wire anchoring kit, comprising:

a guy wire anchoring bracket comprising:

a vertical pile anchor member having a hollow center that is capable of receiving a shaft of a pile;

an offset arm having a first portion with an opening configured to receive the vertical pile anchor member such that when the vertical pile anchor member is positioned within the opening and secured to the offset arm, the offset arm is at an angle relative to the vertical pile anchor member and the vertical pile anchor member extends through the opening such that a first portion of the vertical pile anchor member extends from a first side of the offset arm and a second portion of the vertical pile anchor member extends from a second side of the offset arm, wherein the offset arm is secured to the vertical pile anchor member so that the offset arm is maintained at the angle relative to the vertical pile anchor member;

an eye brace having a first portion secured to the vertical pile anchor member and a second portion secured to the offset arm and an eyelet used for securing a guy wire to the eye brace; and at least one offset pile anchor member secured to a second portion of the offset arm and extending at least partially from the second portion of the offset arm, wherein the at least one offset pile anchor member is secured to the second portion of the offset arm so that the eyelet is located between the vertical pile anchor member and the at least one offset pile anchor, and wherein the portion of the at least one offset pile anchor member extending from the second portion of the offset arm is at substantially the same angle relative to the vertical pile anchor member as the angle between the offset arm and the vertical pile anchor member; and at least one pile connector assembly.

9. The guy wire anchoring kit according to claim 8, wherein the angle of the offset arm relative to the vertical pile anchor member is in the range of between about 20 degrees and about 65 degrees.

10. The guy wire anchoring kit according to claim 8, wherein the angle of the offset arm relative to the vertical pile anchor member is 45 degrees.

11. The guy wire anchoring kit according to claim 8, wherein the at least one pile connector assembly comprises:

a pile cap used for securing the connector assembly to a helical pile; and a pile connecting rod capable of being connected to the pile cap and to the at least one offset pile anchor member.

12. The guy wire anchoring kit according to claim 8, wherein the at least one offset pile anchor member secured to the offset arm comprises a pair of offset pile anchor members secured to the offset arm.

13. The guy wire anchoring kit according to claim 12, wherein the pair of offset pile anchor members are secured to the offset arm at an angle relative to each other.

14. The guy wire anchoring kit according to claim 13, wherein the angle the pair of offset pile anchor members are secured relative to each other is in the range of about 10 degrees and about 90 degrees.

15. The guy wire anchoring kit according to claim 13, wherein the angle between the pair of offset pile anchor members is 45 degrees.

16. A guy wire anchoring system, comprising:

a guy wire anchoring bracket comprising:

a vertical pile anchor member having a hollow center that is capable of receiving a shaft of a pile;

an offset arm having a first portion with an opening configured to receive the vertical pile anchor member such that when the vertical pile anchor member is positioned within the opening and secured to the offset arm, the offset arm is at an angle relative to the vertical pile anchor member and the vertical pile anchor member extends through the opening such that a first portion of the vertical pile anchor member extends from a first side of the offset arm and a second portion of the vertical pile anchor member extends from a second side of the offset arm, wherein the offset an is secured to the vertical pile anchor member so that the offset arm is maintained at the angle relative to the vertical pile anchor member;

an eye brace having a first portion secured to the vertical pile anchor member and a second portion secured to the offset arm and an eyelet used for securing a guy wire to the eye brace; and at least one offset pile anchor member secured to a second portion of the offset arm and extending at least partially from the second portion of the offset arm, wherein the at least one offset pile anchor member is secured to the second portion of the offset arm so that the eyelet is located between the vertical pile anchor member and the at least one offset pile anchor, and wherein the portion of the at least one offset pile anchor member extending from the second portion of the offset arm is at substantially the same angle relative to the vertical pile anchor member as the angle between the offset arm and the vertical pile anchor member;

a plurality of helical piles, wherein a first of the plurality of piles is for positioning within the vertical pile anchor member, and wherein a second of the plurality of piles is for connecting to the at least one offset pile anchor member; and at least one pile connector assembly for connecting the second of the plurality of piles to the at least one offset pile anchor member.

17. A method for interconnecting helical piles to anchor guy wires while reducing the land area needed to anchor such guy wires, the method comprising:

driving a helical pile into the ground at a vertical angle that is substantially parallel to the vertical axis of a free standing structure that the guy wire is to support;

driving one or more offset helical piles into the ground in a direction towards the free standing structure and at the angle relative to the vertical helical pile;

positioning a guy wire anchoring bracket to an end of the vertical helical pile extending above the ground, wherein guy wire anchoring bracket comprises:

a vertical pile anchor member having a hollow center that is capable of receiving a shaft of a pile;

an offset arm having a first portion with an opening configured to receive the vertical pile anchor member such that when the vertical pile anchor member is positioned within the opening and secured to the offset arm, the offset arm is at an angle relative to the vertical pile anchor member and the vertical pile anchor member extends through the opening such that a first portion of the vertical pile anchor member extends from a first side of the offset arm and a second portion of the vertical pile anchor member extends from a second side of the offset arm, wherein the offset arm is secured to the vertical pile anchor member so that the offset arm is maintained at the angle relative to the vertical pile anchor member;

an eye brace having a first portion secured to the vertical pile anchor member and a second portion secured to the offset arm and an eyelet used for securing a guy wire to the eye brace; and at least one offset pile anchor member secured to a second portion of the offset arm and extending at least partially from the second portion of the offset arm, wherein the at least one offset pile anchor member is secured to the second portion of the offset arm so that the eyelet is located between the vertical pile anchor member and the at least one offset pile anchor, and wherein the portion of the at least one offset pile anchor member extending from the second portion of the offset arm is at substantially the same angle relative to the vertical pile anchor member as the angle between the offset arm and the vertical pile anchor member.

* * * * *